United States Patent [19]

Köpke et al.

[11] Patent Number: 4,689,820

[45] Date of Patent: Aug. 25, 1987

[54] HEARING AID RESPONSIVE TO SIGNALS INSIDE AND OUTSIDE OF THE AUDIO FREQUENCY RANGE

[75] Inventors: Wolfgang Köpke; Albert Eggert; Peter Wiener; Gerd-Wolfgang Götze; Rainer Maas, all of Berlin, Fed. Rep. of Germany

[73] Assignee: Robert Bosch GmbH, Stuttgart, Fed. Rep. of Germany

[21] Appl. No.: 550,643

[22] PCT Filed: Jan. 28, 1983

[86] PCT No.: PCT/DE83/00012

§ 371 Date: Oct. 11, 1983

§ 102(e) Date: Oct. 11, 1983

[87] PCT Pub. No.: WO83/03039

PCT Pub. Date: Sep. 1, 1983

[30] Foreign Application Priority Data

Feb. 17, 1982 [DE] Fed. Rep. of Germany ..... 3205686

[51] Int. Cl.[4] ..... H04R 25/00; G08B 3/00

[52] U.S. Cl. ..... 381/68; 340/517; 340/521

[58] Field of Search ..... 179/107 FD, 107 R, 178; 340/517, 521; 381/68, 69, 68.2

[56] References Cited

U.S. PATENT DOCUMENTS

| | | | |
|---|---|---|---|
| 3,029,593 | 4/1962 | Gerace | 179/179 |
| 3,032,651 | 5/1962 | Gisiger-Stähli et al. | 179/179 |
| 3,998,045 | 12/1976 | Lester | 179/7.1 R |
| 4,187,413 | 2/1980 | Moser | 179/107 FD |
| 4,237,449 | 12/1980 | Zibell | 179/107 FD |
| 4,277,980 | 7/1981 | Coats et al. | 73/647 |
| 4,297,677 | 10/1981 | Lewis et al. | 340/148 |
| 4,365,238 | 12/1982 | Kollin | 340/521 |
| 4,422,066 | 12/1983 | Belcourt et al. | 340/517 |
| 4,425,481 | 1/1984 | Mansgold et al. | 381/68 |

FOREIGN PATENT DOCUMENTS

| | | |
|---|---|---|
| 2606691 | 9/1977 | Fed. Rep. of Germany . |
| 2707607 | 9/1977 | Fed. Rep. of Germany . |
| 2716336 | 7/1978 | Fed. Rep. of Germany . |
| 600727 | 6/1978 | Switzerland . |

OTHER PUBLICATIONS

Staab, Wayne J.: "Digital Hearing Aids", *Hearing Instruments,* vol. 36, No. 11, 1985.

VDI Reports, vol. 30, Issue 7, Feb. 1976, "Communication for the Deaf and Blind", p. 2.

*Primary Examiner*—Gene Z. Rubinson

*Assistant Examiner*—Danita R. Byrd

*Attorney, Agent, or Firm*—Frishauf, Holtz, Goodman & Woodward

[57] ABSTRACT

A hearing aid having a microphone (10), a microcomputer (12) for digital signal processing of digitized microphone signals and an electroacoustic converter (14) for acoustic reproduction of the processed digitized signals, is equipped with at least one further sensor (16, 18) responsive to signals outside the acoustical range of audibility. These further sensor signals are processed according to a different program stored in a second memory (19) and supplied as additional data via an output (B2) of the microcomputer (12) preferably to the electro-acoustical converter (14). As a result, data such as the signals of a traffic light transmitter, signals from a paging system, or signals announcing a telephone call, door bell or the like, can be superimposed on the normal auditory functions. By appropriately coordinate signal trains, for example generated in accordance with the program stored in the second memory, a hearing-impaired person can easily distinguish among these additional functions.

20 Claims, 2 Drawing Figures

HEARING AID RESPONSIVE TO SIGNALS INSIDE AND OUTSIDE OF THE AUDIO FREQUENCY RANGE

The invention relates to a digital hearing aid in which sensed signals are digitally processed.

BACKGROUND

In the course of modern microcomputer technology, it has also become known to use microcomputers for hearing aids for hearing-impaired persons. To this end, the analog input signal of the microphone must be converted into a data word and then the output data word, which was formed by digital conversion in the microcomputer in accordance with the desired auditory function, must in turn be delivered as an analog signal to an electro-acoustic converter (for example a receiver). It has now been found that the opportunities afforded by a microcomputer for this purpose are often insufficiently well exploited and a desire for greater versatility exists.

THE INVENTION

It is an object to expand the versatility of hearing aid which includes a microcomputer to permit a hearing-impaired person to receive information provided in a form which is other than audible spoken form.

Briefly, a hearing aid which includes a microcomputer has at least one additional or further sensor coupled thereto, which further sensor is responsive to signals which are outside the audible range, for example signals which are optical, electrical, magnetic, electromagnetic, or ultrasonic signals. These signals may be received in digital or analog form; if received in digital form, they can be directly applied to the microcomputer for processing in accordance with the program stored in an additional memory. The thus processed signal may be applied to the acoustic output transducer, such as an earphone, of the hearing aid. In one form, signals may be received in the form of digital signals transmitted in the infrared wave length, and reproduced, for example, as a sequence of tones in accordance with the program stored in the additional memory. The microcomputer can also provide additional outputs, for example for retransmission to transducers, in the form of infrared signals of speech picked up by the microphone to enable a group of listeners with similar equipment to clearly hear the spoken word, also over distances which are not normally within the audible range of the listener.

The hearing aid according to the invention has the advantage that because of the opportunity for additionally detecting further sensor signals, the hearing-impaired person can be provided with a greater variety of information which he would otherwise perceive only with relatively great difficulty or which he could detect only using additional devices. Thus, a single device includes the function of several devices, with important data being superimposed acoustically on the basic functions.

A particularly advantageous possibility in the classroom or in discussions among a relatively large number of hearing-impaired persons is that of requesting information via a second digital output of the hearing aid. If this further output is connected with a transmitter, in particular an infrared or radio transmitter, then the transmitted signal can be received via a respective further sensor in the hearing aids of the other participants and converted into acoustical information.

DRAWINGS

FIG. 1 shows an exemplary embodiment of the invention in the form of a block circuit diagram and explained in detail in the ensuing description; and FIG. 2 is a diagram showing the system in use and responding to different types of inputs.

DETAILED DESCRIPTION

Figure 1:
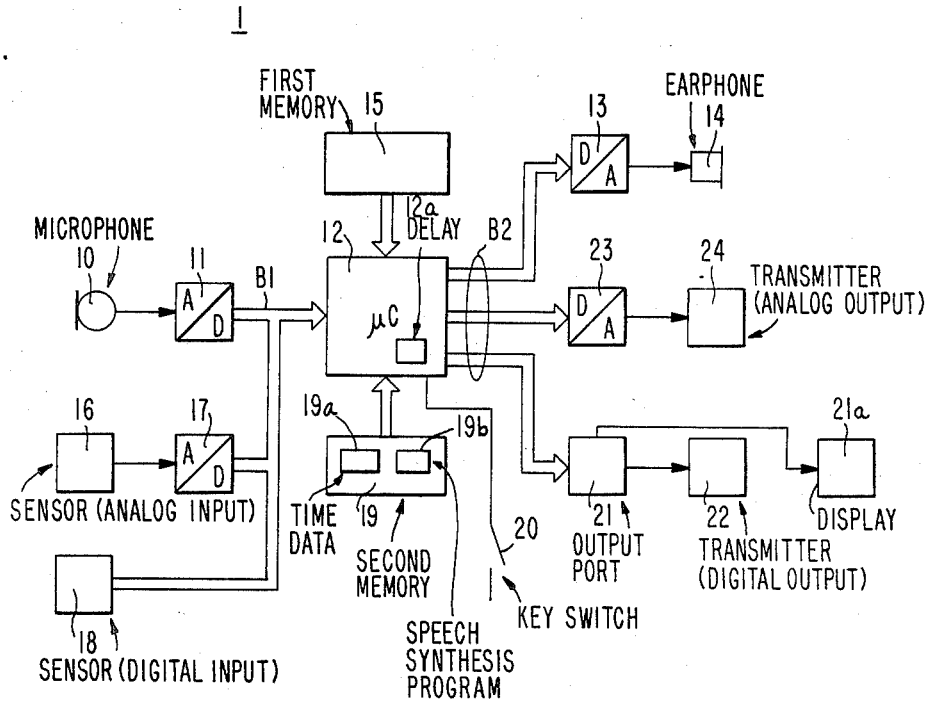

The signal processing system 1 is coupled to three input sensors 10, 16, 18. A microphone 10 functioning as an acoustic sensor is connected via an analog-to-digital (A/D) converter and a bus B1 with a microcomputer 12. First outputs of this microcomputer 12 available at a bus B2 are connected via a digital-to-analog (D/A) converter 13 with an electro-acoustic converter 14. The electro acoustic converter 14 transmits speech data acoustically into the opening of the ear. This converter 14 thus operates as an earphone. The conversion of the input data words into output data words corresponding to the desired auditory function or acoustic profile takes place in the microcomputer 12 with the aid of the sequence of instructions stored in the memory 15 containing instructions.

In accordance with the invention, a second analog sensor 16 is connected via a further analog-to-digital (A/D) converter 17 and bus B1 to the microcomputer 12; a third digitally responsive sensor 18 is connected directly to the bus B1 and with inputs of the microcomputer 12. These sensors 16, 18 serve to receive optical, electrical, magnetic, electromagnetic or ultrasonic signals, that is, signals which are outside the acoustic audibility range. The signals received by the sensor 18 must naturally be received directly in digital form because no analog-to-digital converter is included in the connections to the microcomputer.

The processing of transduced signals from the further sensors 16, 18 takes place with the aid of the set of instructions for additional functions which is stored in the second memory 19 containing instructions. Additional functions can be requested by means of a key 20 connected with the microcomputer 12. The additional functions can naturally also be switched on automatically, or a switch-over to them can be made whenever a signal of an additional sensor 16, 18 is present.

Further outputs of the microcomputer 12 are connected to an output port 21 and a further digital-to-analog (D/A) converter 23. The output data present there are delivered to a transmitter 22 or 24, respectively, which may be formed by an optical, acoustical or electromagnetic transmitter.

OPERATION OF THE EXEMPLARY EMBODIMENT

First, auditory function of the hearing aid: The sound waves received by the microphone 10 are supplied in the form of digital data to the microcomputer 12, where they are converted in accordance with a desired acoustic profile and with the aid of the program in the instruction memory 15, so that at the output side they are supplied in turn in the form of an amplified analog signal, to the electroacoustic converter 14 and thus to the ear.

Figure 2:
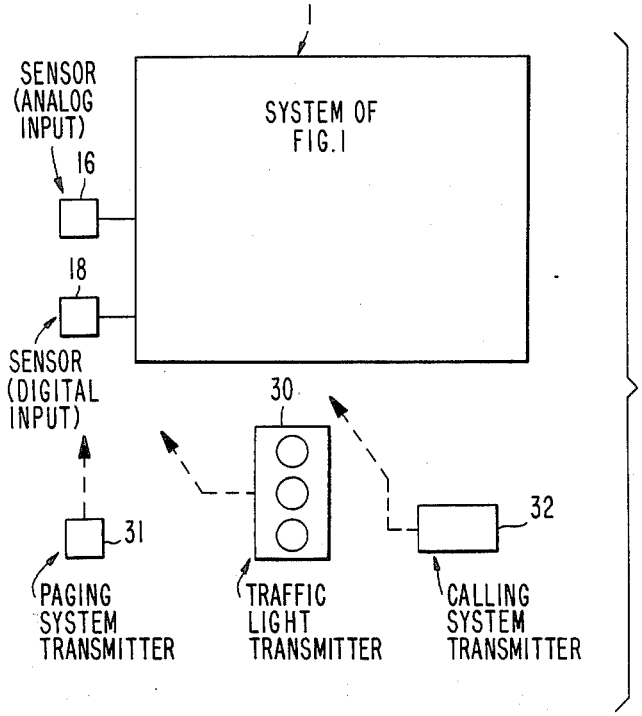

In accordance with the invention, further signals can also be supplied to the microcomputer 12 via the sensor 16. Such signals may, for example, be signals from a traffic light transmitter 30 for the blind (FIG. 2), signals from a paging system 31, signals announcing a call on a calling system 32 , such as a telephone or door bell or the like. The microphone 10 has been omitted in FIG. 2 since it does not perform a function when system 1 responds to input signals from units 30, 31, 32. If a sensor signal from uints 30, 31, 32 appears, then it is processed with the aid of the program stored in the further program memory 19 and is expressed for instance in the electro-acoustic converter 14, as a specific sequence of tones, which the person under discussion recognizes as the received information. For example; a transmitter (electromagnetic or infrared for example) may be provided in a telephone, and if there is a call, the transmitter sends a wireless signal to the hearing aid. The wirelss signal is then reproduced in the hearing aid in form of a specific acoustic signal, from which the hearing-impaired person understands that the telephone is ringing. If a plurality of such sensor signals is provided, then each can be recognized by means of a different tone sequence.

Since a time function can easily be realized in the microcomputer by a time data unit 19*a*, it is readily possible to request the time of day, for example via the key 20. This may be done in form of speech information via a speech module 19*b* which is either contained in or accompanies the microcomputer 12, via the electro-acoustic converter 14; however, an output via the output port 21 is also possible. A clock display 21*a* is then connected to the port 21, for instance via an electric line.

A transmitter 22 may also be advantageously connected to the output port 21. This is of particular advantage, for instance in teaching situations, and conferences and discussions among hearing-impaired persons, because the spoken word is often poorly transmissible acoustically over relatively long distance. Thus, the sound waves of the person speaking are received in his own hearing aid via the microphone 10 and supplied not only to his own electroacoustic converter 14 but also via the transmitter 22 in the form of infrared signals, electromagnetic waves or the like to the hearing aids of the other participants. There they are received in the corresponding sensor 18 and converted back into sound waves. A transmitter 24 can be triggered via the digital-to-analog (D/A) converter 23; but in contrast to the foregoing, this transmitter 23 transmits analog signals, which are then received via the sensor 16 of other hearing aids.

A further possible way to improve comprehension over the telephone and also the normal auditory function of the hearing aid is the delaying of the signals in the microcomputer 12, as schematically shown by delay 12*a*. It can easily happen that, when making a telephone call, either via a hearing aid or a normal auditory operation, there is feedback, making comprehension difficult or impossible. This is prevented by means of delay in the microcomputer 12. Finally, it must also be noted that such hearing aids are also applicable to those with normal hearing, with appropriate modification. An example would be the combination of a paging system and a traffic light signal receiver for the blind in one device, which may be disposed behind the ear or in a pair of glasses of the user.

We claim:

1. A hearing aid for a user having an acoustic sensor (10) responsive to sound signals of the audio frequency range, and providing first analog electrical signals representative of said sound signals within said audio frequency range;

an analog-to-digital converter (11) receiving the first analog signals and converting the first analog signals into first digital signals;

a microcomputer (12) coupled to receive the first digital signals;

a first memory (15) coupled to said microcomputer, said first memory having a program stored therein;

said microcomputer including means for processing the first digital signals in accordance with said program stored in said first memory and for producing processed first digital signals;

a digital-to-analog converter (13) coupled to receive said processed first digital signals from the microcomputer (12) at an output (B2) of the microcomputer;

an electroacoustic transducer (14) for converting said processed first digital signals into audible analog output signals representative of said sound signals, for transmission to the ear of a user, at least one further sensor (16, 18), said at least one further sensor being responsive to sense signals outside of said audio frequency range and which are outside of the sensing range of said first mentioned acoustic sensor (10), and providing second electrical signals representative of said signals sensed thereby;

means (17, B1) for applying said second electrical signals, in digital form, to said microcomputer (12) to thereby apply to said microcomputer second digital signals; and a second memory (19) coupled to said microcomputer (12), said second memory having stored therein a program containing instruction information for controlling said microcomputer (12), said program stored in said second memory being different from said program stored in said first memory; and said microcomputer (12) including means for digitally processing data represented by said second digital signals in accordance with said program stored in said second memory and for providing further digitally processed signals at said output (B2) of said microcomputer.

2. The hearing aid of claim 1, wherein the further digitally processed signal provided at the output (B2) of the microcomputer (1) and processed in accordance with the program of the second memory (19) are coupled to said digital-to-analog converter (13) and to the electroacoustic transducer (14).

3. The hearing aid of claim 1, wherein said at least one further sensor (16, 18) is responsive to signals from a traffic light transmitter for blind persons.

4. The hearing aid of claim 1, wherein said at least one further sensor (16, 18) is responsive to paging system signals.

5. The hearing aid of claim 1, wherein said at least one further sensor (16, 18) is responsive to calling system signals.

6. The hearing aid of claim 1, wherein said second memory (19) contains at least one group of data required by the user;

and wherein a group of said at least one group of data provides the time-of-day.

7. The hearing aid of claim 1, wherein said second memory (19) contains a speech synthesis program;

and said microprocessor (12) provides digital speech output signals at its output (B2).

8. The hearing aid of claim 1, wherein said output (B2) from the microcomputer (12) includes a digital output port (21).

9. The hearing aid of claim 8, further including a transmitter (22) providing digitally transmitted output signals coupled to said digital output port (21).

10. The hearing aid of claim 8, further comprising a second digital-to-analog converter (23) coupled to said output (B2) from the microcomputer (12) and energized to provide output data supplied by the microcomputer (12) in response to said signals outside of said audio frequency range.

11. The hearing aid of claim 10, further including an analog data transmitter (24) coupled to the second digital-to-analog converter (23) for transmitting output data in analog form derived from the microcomputer (12) and the second digital-to-analog converter (23).

12. The hearing aid of claim 9, wherein said transmitter (22) comprises an optical display (21*a*).

13. The hearing aid of claim 1, wherein the microcomputer (12) includes means for delaying signals received from at least one of the sensors (10; 16, 18), and for processing the respective signals from the respective sensor with delay.

14. The hearing aid of claim 1, wherein said at least one further sensor (16, 18) is responsive to sense input signals including at least one of:

optical signals, electrical signals, magnetic signals, electro-magnetic signals, ultrasonic signals.

15. The hearing aid of claim 1, wherein the second memory (19) has stored therein program instructions acting on second digital signals of predetermined characteristics and providing said further digitally processed signals at the output (B2) from the microcomputer having characteristics specifically representative of said second digital signals, said electroacoustic transducer (14) converting said further digitally processed signals into a specific sequence of audible tones to permit recognition of received information by a user of the hearing aid incoded form.

16. The hearing aid of claim 14, wherein the second memory (19) has stored therein program instructions acting on second digital signals of predetermined characteristics and providing said further digitally processed derived signals at the output (B2) from the microcomputer having characteristics specifically representative of said second digital signals, said electroacoustic transducer (14) converting said further digitally processed signals into a specific sequence of audible tones to permit recognition of received information by a user of the hearing aid in coded form.

17. The hearing aid of claim 1, wherein said at least one further sensor (16) comprises a sensor responsive to analog input signals and providing electrical transduced analog signals;

and a further analog-to-digital converter (17) is provided, coupled to said at least one analog sensor (16) and provides said second electrical signals in digital form to the microcomputer (12).

18. The hearing aid of claim 1, wherein said at least one further sensor (18) comprises a sensor responsive to digital input signals and furnishing said second electrical signals to the microcomputer (12).

19. The hearing aid of claim 1, further including a digital data input bus (B1) connected to an input of said microcomputer;

and wherein said first analog-to-digital converter (11) is coupled to said digital bus (B1) and said at least one further sensor (16, 18) provides said second electrical signals, in digital form, and is coupled to said digital bus (B1), said digital bus forming, in part, the means (17, B1) for applying said second electrical signals, in digital form, to the microcomputer (12).

20. The hearing aid of claim 19, wherein said at least one further sensor comprises an analog sensor (16) and an analog-to-digital converter (17) coupled to receive analog output signals from said analog sensor and providing said second electrical signals to said bus (B1).

* * * * *